United States Patent [19]

Dohet

[11] 4,433,700

[45] Feb. 28, 1984

[54] PANEL STRUCTURE

[76] Inventor: Pierre E. Dohet, 109 S. Lee St., Alexandria, Va. 22314

[21] Appl. No.: 270,927

[22] Filed: Jun. 5, 1981

[51] Int. Cl.[3] ..... E04B 1/347

[52] U.S. Cl. ..... 135/97; 135/102; 135/106; 52/63

[58] Field of Search ..... 135/1 R, 4 R, 3 R, 3 E, 135/7.1 R, 15 PQ, 5 E, DIG. 5, 4 K, 102, 106, DIG. 1, DIG. 5, 95, 97; 52/222, 63, 86; 160/327, 328, 351; 47/29, 31; 244/153

[56] References Cited

U.S. PATENT DOCUMENTS

| | | | |
|---|---|---|---|
| 1,814,811 | 7/1931 | Kramer et al. | 244/153 R |
| 2,611,427 | 9/1952 | Du Mais et al. | 160/351 |
| 3,051,185 | 8/1962 | Reynolds | 47/29 |

FOREIGN PATENT DOCUMENTS

| | | | |
|---|---|---|---|
| 1265777 | 12/1929 | France | 135/1 R |

*Primary Examiner*—Richard G. Pinkham
*Assistant Examiner*—T. Brown
*Attorney, Agent, or Firm*—Carl W. Tomlin

[57] ABSTRACT

A collapsible panel structure consisting of at least one rod member, restraint elements secured to the rod member and a removable stress device acting to exert a continuous force between the rod member and the restraint elements. In one modification, two rod members have attached thereto a sheet of flexible material or fabric which acts as the restraint elements. Additional cable restraints can be employed joining the outer ends of adjacent rod members. The rod members are slightly bowed, and a bar member is secured centrally thereto in substantially chordal relationship. The stressing member rolls or slides on one bar member and pivots on the other. The stressing member is a slightly precambered one-piece rod or tube of spring material, carrying bifurcations at both of its ends to partially encompass the chord members, one bifurcation acting as a pivot and the other as a slide. The stressing member is forced along one bar member, to substantially dead center position, which action causes the bow in the stressing member to increase, thereby generating a continuously acting force on the restraint elements to thereby form a self-supporting structure. The sheet of flexible material rests on top of the stress-producing member, and when used as a cover for an excavation, any load such as wind or earth thrown on top of the flexible material, will act to increase the force generated by the stressing member, which in turn will act as a support for said load, preventing downward bowing of the flexible member.

18 Claims, 22 Drawing Figures

PANEL STRUCTURE

CROSS REFERENCES

Reference is made to my prior U.S. Pat. Nos. 3,416,170 issued Dec. 1968 and 4,091,485 issued May 30, 1978.

FIELD OF THE INVENTION

The subject invention relates to panel structures which may be rapidly erected and collapsed. The principles disclosed may be employed in formation of a cover for a foxhole, or when several panels are joined together, to form a skelton or a covered shelter. In skeletal form, the framework is adapted to receive camouflage material for military purposes.

BACKGROUND OF THE INVENTION

One of engineering's oldest problems is how to make a structure of the lightest materials and containing the least number of parts but retaining the necessary strength. It is well known that a structure may be made to carry a greater load if it is prestressed to oppose the working stresses. There are many ways to eliminate excess material in a structure. In the subject invention this has been accomplished by changing the geometry to arrange the parts of the structure in a more effective way whereby a lesser number of parts each work to their allowable limit thereby eliminating excess parts and the consequent additional weight and complexity. This has been accomplished by the subject invention by prestressing the fabric or cable restraints without consequent twisting or buckling of the panel.

In developing the subject device, a structure was formed by attaching a skin or fabric member to opposite ends of rod members which rod members were forced apart by two resilient poles to place a force on the rod members to thereby prestress the skin. It was found that the device, when placed over an excavation, such as a foxhole, was able to support more than twenty inches of dirt completely covering the skin without permanent deformation of any of the components of the structure. The result was that the resilient poles were further compressed and the rod members were drawn toward each other and the skin assumed a catenary shape and extended into the excavation. This fault has been eliminated by employing a single, slightly pre-bowed stress-producing member made of spring material over which the skin member is disposed. When this device was loaded, both by dirt or by a wind load, in the case of an enclosure, the skin acted against the pre-bowed stress-producing member to restrain further outward bowing thereby eliminating the catenary problem.

In accordance with this invention, controlled longitudinal extension is provided in the panel structure by means of a chord compression system. In its simplest form, namely a rectangular structure, a pair of spaced-apart, slightly bowed rod members are provided. A flexible cable restraint, or fabric restraint, or both is secured to at least each of the terminal ends of the rod members. A stress-producing member is interposed between the rod members forming thereby a prestressed framework. When a skin or fabric restraint member is secured to the rod members and or cable members and disposed on top of the bowed stress-producing member and an external dynamic load is applied, such as by the wind in the case of a shelter, or by a static load, such as dirt in the case of a foxhole cover, the forces generated by the loading are opposed by the stress-producing member and equilibrium is reached without any considerable alteration in the original external shape or dimensions of the panel.

It will be seen from the above that the panel structure of this invention consists, essentially, of three members, which are, a stress-producing member, a restraint member and a means to transmit a uniform loading from the stress member to the restraint member.

The same reference characters refer to like parts in the several views.

Figure 1:
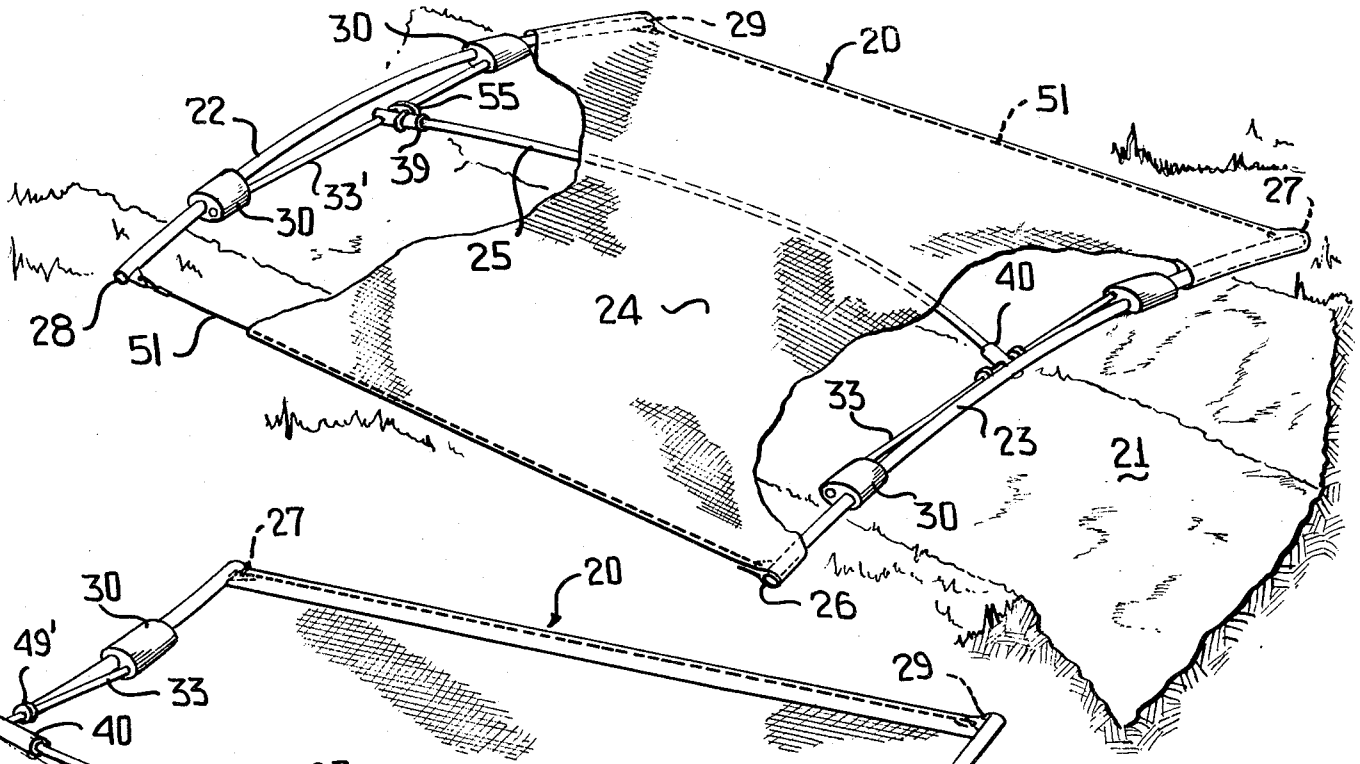
FIG. 1 is a plan view in perspective of the panel structure disposed over an excavation.
Figure 2:
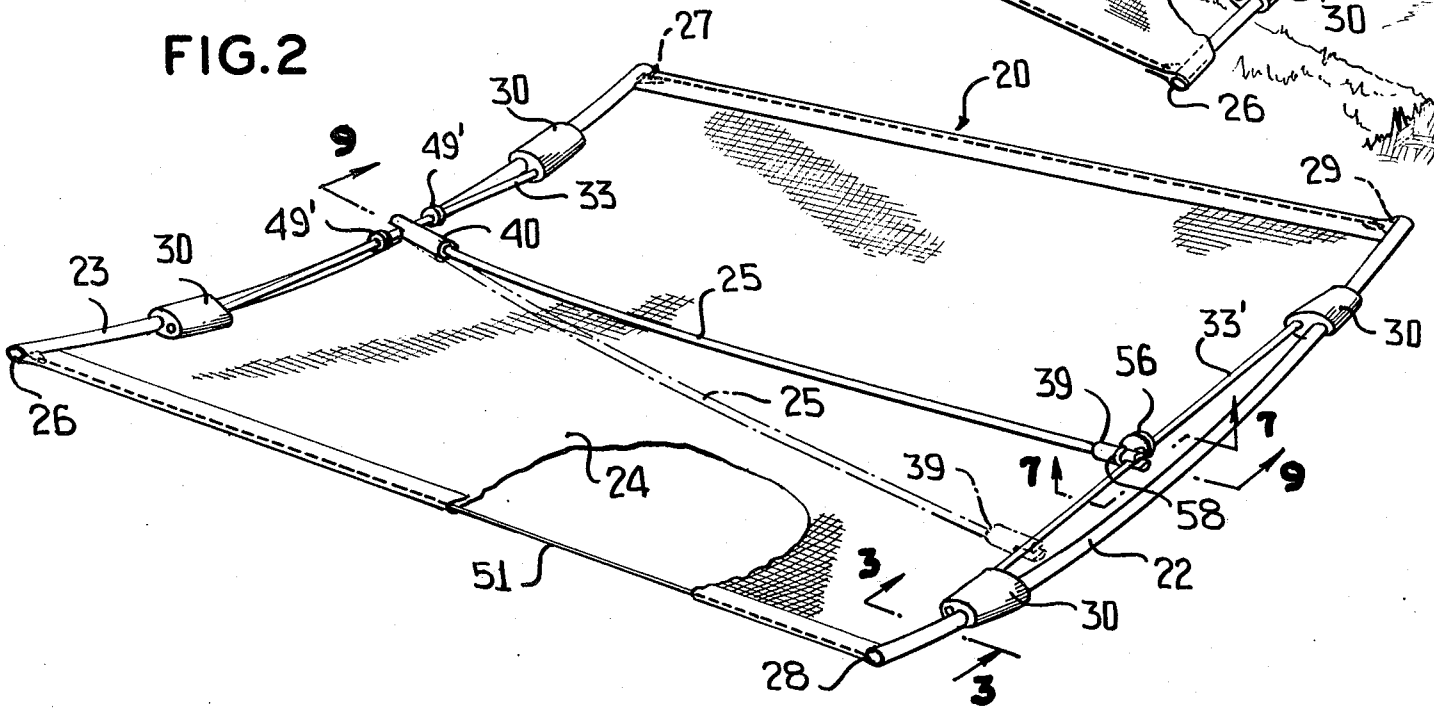
FIG. 2 is an underside view of the panel structure of FIG. 1.

Note particularly FIG. 1 and FIG. 2 wherein a panel structure 20 is disposed over an excavation 21, such as a trench or foxhole.

The panel structure consists generally of two free standing or floating rod members 22, 23 of similar configuration, a restraint member 24 of fabric or other sheet-like material secured in any suitable manner such as by cement, sewing, etc., to each of the rod members 22, 23, and a force or stress-generating member 25 disposed between and acting upon said rod members 22, 23 to force said rod members apart. The restraint member 24 acts to oppose the force generated by the stress member 25. The term "free standing" or "free floating" as used herein and in the appended claims and applied to the rod members 22, 23, defines the rod members as being free from any attachment to the ground, a plate or bulkhead member. The rod members are therefore free to move independently in any plane.

The rod members 22, 23 are each formed of similar arcs of great circles and have secured thereto intermediate the ends 26, 27, 28, 29 thereof, similar fittings 30. The rod members 22, 23, may be either hollow or solid.

Figure 3:
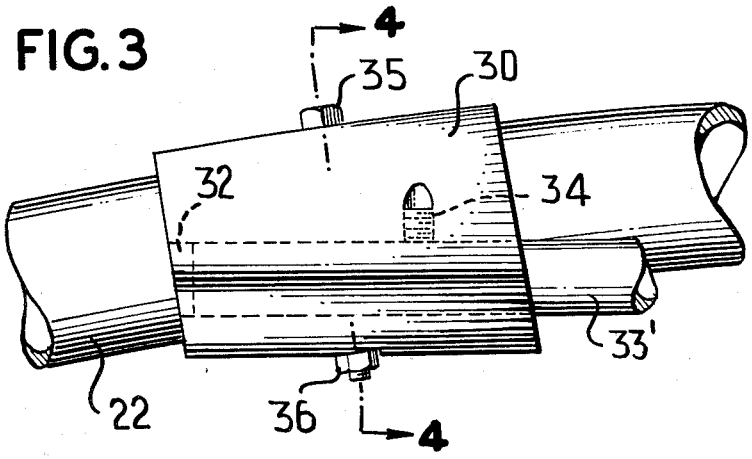
FIG. 3 is a detail taken on line 3—3 of FIG. 2.
Figure 4:
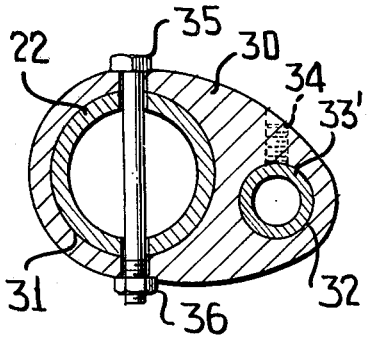
FIG. 4 is a section on line 4—4 of FIG. 3.

Attention is called to FIGS. 3 and 4 wherein the fittings 30 have a cylindrical bore 31 therein adapted to receive a rod member 22 or 23. The axis of the bore 31 is preferably curved on the same radius as that of rod members 22 or 23. Fitting 30 has formed in one side thereof a second cylindrical bore 32, which bore 32 has a straight axis. A horizontal plane passed through the axis of bore 32 will intersect a vertical plane passed through the curved axis of bore 31 in such a manner that if the axes 31, 32 were extended, the plane of the axis 32 would intersect the plane of the axis 31 forming a chord of a circle, the radius of which would be the radius of the circle forming the arc in rod member 22. A bar member 33 or 33', which may be either solid or hollow, is secured in bore 32 by any suitable means, such as a set screw. Fittings 30 are secured to rod members 22, 23 by any suitable means, such as bolt 35 and nut 36.

Figure 5:
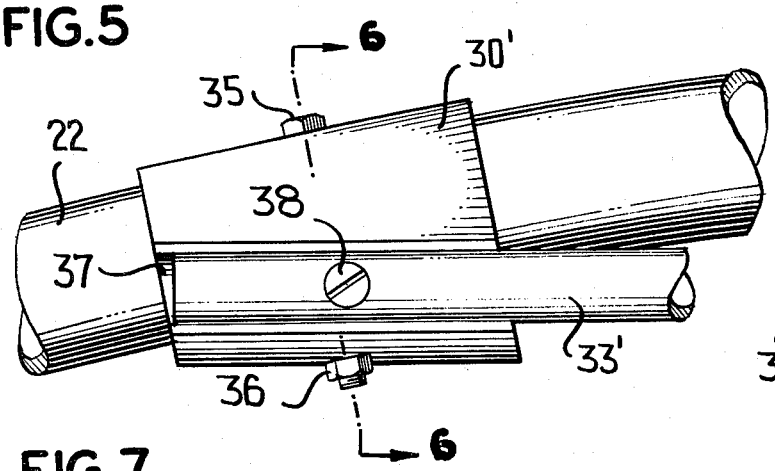
FIG. 5 is a modification of the detail of FIG. 3.
Figure 6:
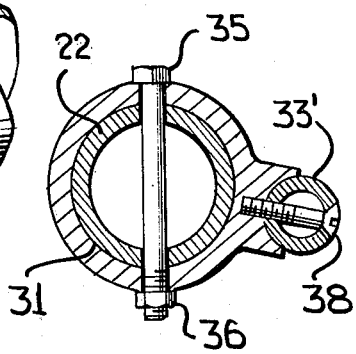
FIG. 6 is a section on line 6—6 of FIG. 5.

FIGS. 5 and 6 show a modified form of the fittings 30 of FIGS. 3 and 4. In the modified form the bar member 33' is received in a channel 37 of suitable configuration formed in the wall of the fitting 30; the bar member 33' being retained in the channel 37 by any suitable fastening means, such as bolt 38. The axis of the channel 37 is disposed in a relationship to the axis of bore 31 in a manner similar to that described above with relation to the axes 32 and 31. Bar members 33' are of smaller peripheral dimension as that of rod member 22, 23.

The fittings 30 could be fabricated in mating sections, such as by casting, for simplicity of manufacture.

Referring again to FIGS. 1 and 2, it will be seen that fittings 30 are assembled on rod members 22, 23 equidistant from the ends 26, 27; 28, 29 of the respective rod members. The fittings 30 are so disposed on rod members 22, 23 that the longitudinal center of each bar member 33, 33' is below the longitudinal center of its respective rod member 22, 23, and the bar members 33, 33' are disposed in opposing relation and to the left and right of rod members 22, 23 respectively, as seen in FIGS. 1 and 2.

Referring again to FIGS. 1 and 2, stress bar 25 is made of spring material and is of a length slightly greater than the distance apart of rods 22, 23 as limited by the restraint means 24. Bar 25 is slightly bowed in its free or unstressed condition. Bifurcated fittings 39, 40 are assembled on the outer ends of stress bar 25.

Figure 9:
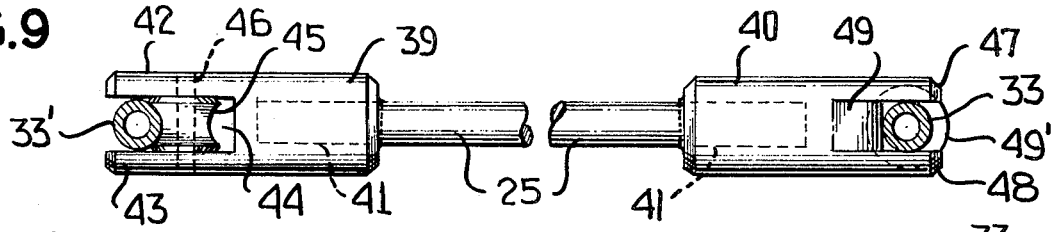
FIG. 9 is a side elevation in section of the stress bar taken on line 9—9 of FIG. 2.
Figure 10:
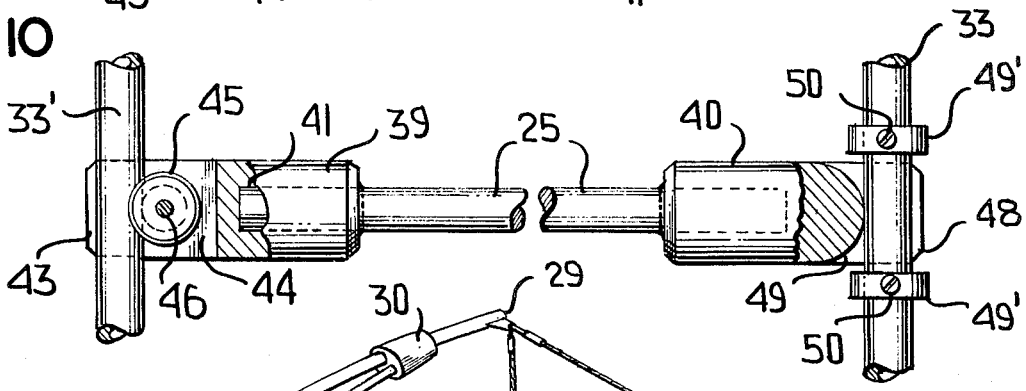
FIG. 10 is a plan view of FIG. 9 with parts broken away and shown in section.

Referring to FIGS. 9 and 10, fittings 39 and 40 each have an aperture 41 therein at one end thereof to receive one end of stress rod 25, the stress rod and fittings being secured together by any suitable means, such as welding. The other end of fitting 39 is bifurcated at 42, 43, the inner end 44 thereof receiving roller 45 rotatably mounted on pin 46, which roller 45 is adapted to engage rod member 33'. The opposite end of fitting 40 is bifurcated at 47, 48. The base formed by the furcations 47, 48 is semi-cylindrical and adapted to slide and pivot about bar member 33. Stop members 49 are mounted on bar member 33 and retained thereon by any suitable means such as set screws 50. The stop members 49' are spaced from fitting 40 to permit limited pivotal and sliding movement of stress bar 25 on bar member 33.

If desired, further restraints can be applied to the ends 26, 28; 27, 29 of rod members 22, 23. These further restraints are in the form of flexible cable members 51. Note FIGS. 12 and 13 which disclose a preferred method of securing the cables 51 to the rod members 22, 23. A tang member 52 having an aperture 53 therethrough, is secured at the ends 26, 27, 28, 29 of rod members 22, 23 by any suitable means, such as welding, shown at 54. Cables 51 are passed through apertures 53 of tangs 52 and folded back upon themselves to receive a swaged fitting 51'.

Figure 7:
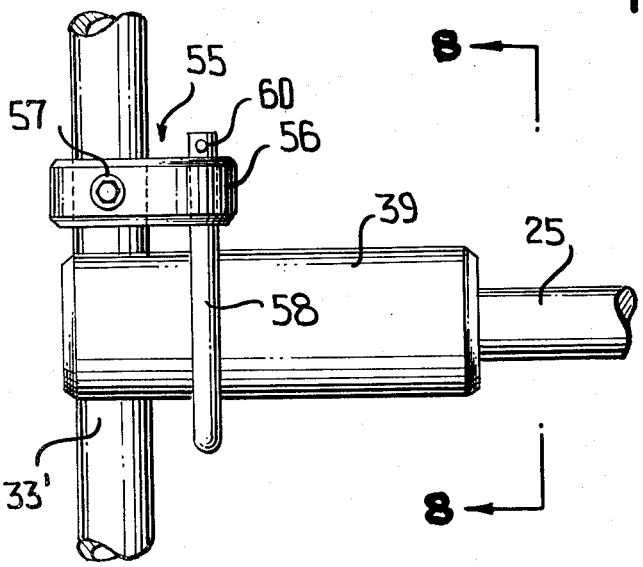
FIG. 7 is a detail of the latch taken on line 7—7 of FIG. 2.
Figure 8:
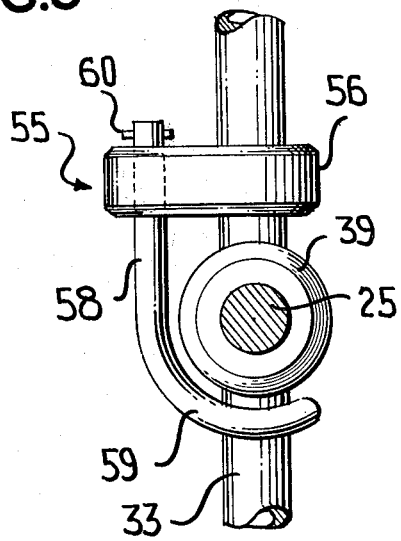
FIG. 8 is a section on line 8—8 of FIG. 7.

With reference to FIGS. 1 and 2, stress bar 25 is under compressive loading when assembled between bar members 33, 33' and is retained on bar member 33' by means of the bifurcated fitting 39 and on bar member 33 by means of bifurcated fitting 40. Additional retaining means 55 (see FIGS. 7 and 8) is provided to restrain rod 25 from lateral movement on bar 33. Retaining means 55 consists of a clamping collar 56 mounted on bar 33' and held in position thereon by any suitable means, such as set screw 57. Hook member 58 is pivotally mounted in an aperture in the collar 56, the hook 59 being of such a radius to partially encompass fitting 39 as shown in FIG. 8. Pin 60 prevents loss of hook 58 from fitting 55.

The unassembled device of FIGS. 1 and 2 is stored in a cylindrical roll or package, including the stress bar 25. To assemble, the roll is extended in the inverted position of FIG. 2. Fitting 40 is inserted over bar member 33 on rod 23 and between retention collars 49', stress rod 25 assuming the dotted line position shown in FIG. 2. Stress rod 25 and fitting 39 are then caused to travel along bar member 33' until contact is made with collar 56 and latch 58 is then placed in position to retain stress rod 25 in its assembled position. It will be appreciated that as rod member 25 and fitting 39 approach collar 56 tremendous mechanical advantage accrues, stressing bar 25 and placing the restraint means 24 and or 51 under considerable tensile loading. Stress bar 25 assumes an arc of lesser radius than it had in its unassembled position but retains it original longitudinal length as measured along the periphery. Since stress bar 25 is of spring material, a continuing elastic force is exerted on the restraint means 24 and or 51. In its operative position as shown in FIG. 1, the fabric-like restraint or cover means 24 rests on top and covers stress bar 25. Should loose earth be piled upon the restraint or cover member 24, additional loading of stress bar 25 would result tending to cause stress bar 25 to assume an arc of a radius less than that occasioned by the erection of the device to assembled position. Since the restraint or cover member 24 is resting on top of stress bar 25, any uniform external loading, such as above described would tend to restrain further bowing of stress rod 25. A conditon of equilibrium is reached between the external load and the degree of arc formed in the stress rod 25. This arrangement restricts movement of rods 22, 23 toward each other and further restricts sagging of the restraint or cover 24. The original arc in rod members 22, 23 and the loading of bar members 33, 33' below the arc of rod members 22, 23 as shown, completely eliminates any tendency of the panel structure to warp when under load.

Figures 14, 15, 16, 19, 20:
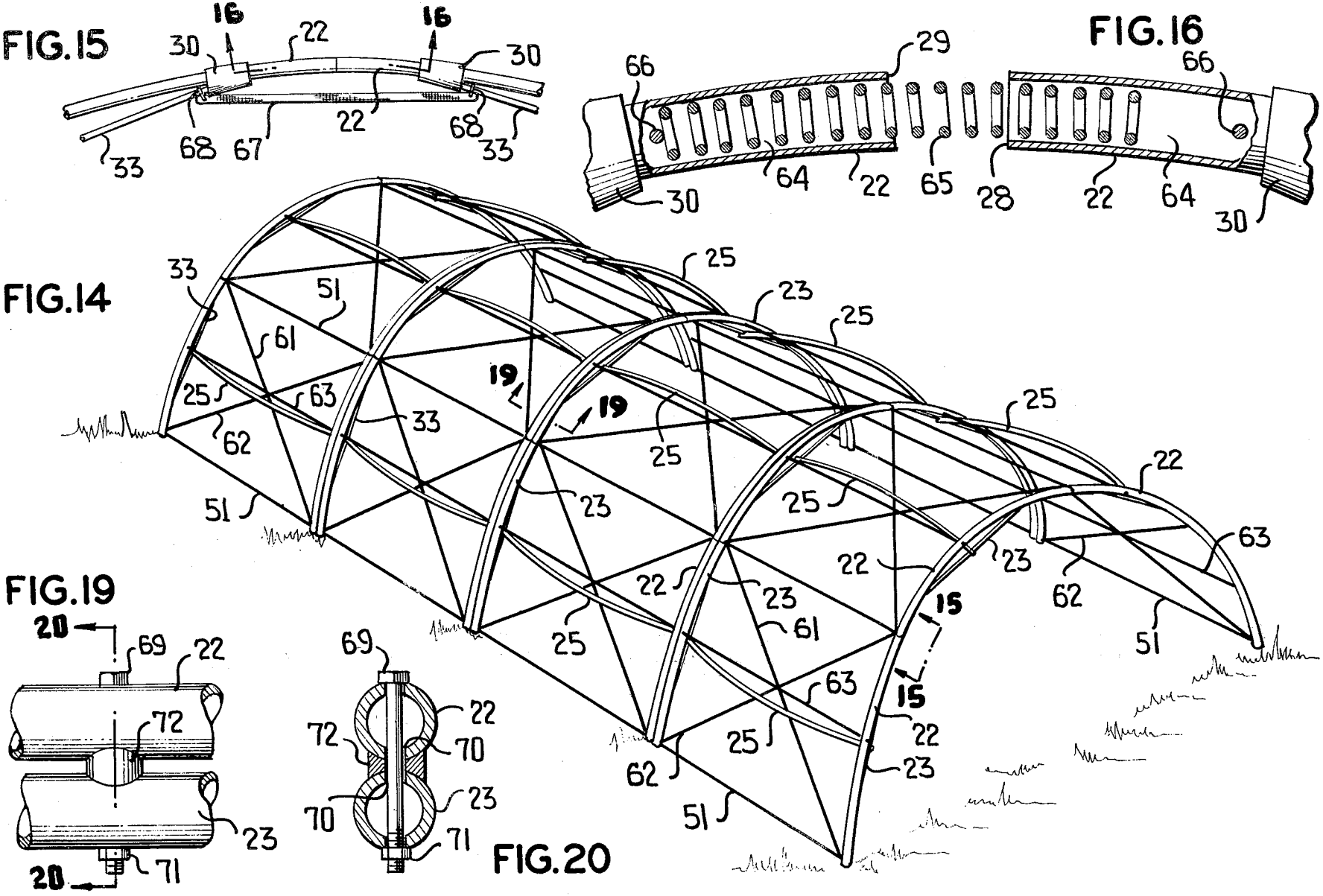
FIG. 14 is an elevation in perspective of several of the panel structures of FIG. 11 secured together.
FIG. 15 is an elevation looking in the direction of line 15—15 on FIG. 14 showing a means to secure the assembled panels together.
FIG. 16 is a sectional view on line 16—16 of FIG. 15.
FIG. 19 is a view taken on line 19—19 of FIG. 14 and showing the manner of securing several panels together.
FIG. 20 is a section on line 20—20 of FIG. 19.

Reference has been made above to the use of the panel structure as a cover for a foxhole or other excavation, but the same principles apply when several panels are assembled together, as shown in FIG. 14, in which case the loading would be occasioned by snow, wind, etc.

It is to be emphasized that a fabric 24 of a material of sufficient strength to withstand the anticipated loads on the panel, has proved satisfactory without the addition of cables 51. The addition of cables 51 permits the use of a fabric of weaker characteristics than when a fabric alone is employed as the restraint.

Figure 11:
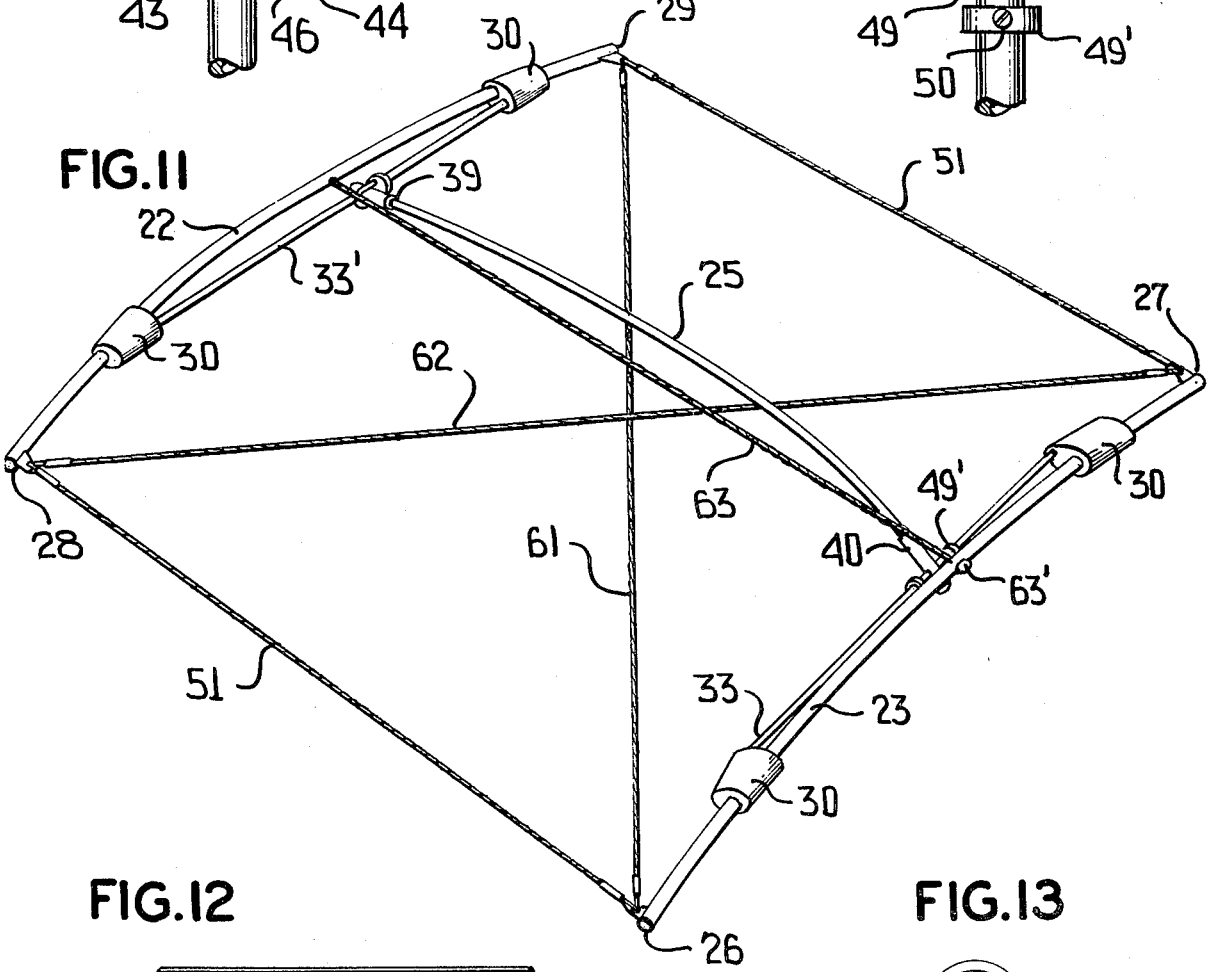
FIG. 11 is a plan view in perspective of a modification of the device of FIGS. 1 and 2.
Figure 12:
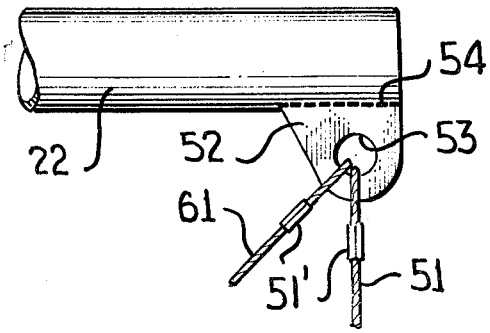
FIG. 12 is a plan view of one of the outer cable securing means of FIG. 11.
Figure 13:
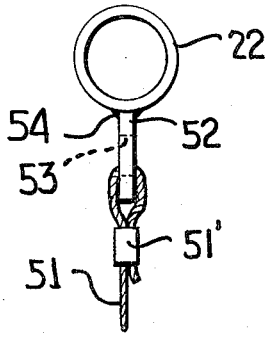
FIG. 13 is an end view of FIG. 12.

Attention is now drawn to the modification shown in FIGS. 11–13. In this modification the fabric restraint or cover 24 has substituted therefor a system of cables, which produce a skeleton-type of framework or panel. Diametrically opposite ends 26, 29; 27, 28 of rod members 22, 23 are connected by flexible cables 51 and by crossed cables 61, 62. Cables 51, 61, and 62 are secured to the said ends of rods 22, 23 by the fittings such as 52 shown in FIGS. 12 and 13. An additional cable 63 is secured by any suitable means to each of rods 22, 23 centrally of the respective ends 28, 29 and 26, 27. The securing means shown consists of an aperture formed in each rod 22, 23, the cable being passed through each aperture and a swaged fitting 63' applied to each of the ends of the cable 63.

Assembly of stress bar 25 in the device of FIG. 11, to the bars 33, 33' is accomplished in the same manner as that described for the device of FIGS. 1 and 2. The cables 51, 61, 62 act to maintain the substantially parallelogram configuration of the panel, and cable 63 acts to restrain outward, essentially pivotal movement of one rod 22 away from its complementary rod 23.

If desired a flexible fabric cover, similar to the fabric cover 24 of FIG. 1, could be applied over the skeleton framework above described with respect to FIG. 11.

A plurality of the panel structures of FIG. 11 can be assembled to form a skeleton framework as shown in FIG. 14, which may receive and support a tarpaulin-like cover to form a shelter, or camouflage material to conceal military equipment.

A plurality of panels such as shown in FIGS. 1 and 2 or FIG. 11 may be secured together to form a structure such as shown in FIG. 14, in which figure, the open framework panel structure of FIG. 11 has been shown for purposes of illustration, it being understood that the panel structure shown in FIGS. 1 and 2 can be assembled together by the same means as that of the device of FIG. 11.

In FIG. 14 four panels such as described with respect to FIG. 11 are joined together in such a manner that the stress bars 25 are in parallel relationship to thereby form what is referred to herein, as a unit. The overall dimensions of the individual panels, determines the height and width, of the unit.

Each rod member 22, 23 has an open bore or cavity 64, see FIG. 16, adapted to receive therein an elastic plug member 65, shown here as a coiled compression spring. Plug locator pins 66 are provided equidistantly from the ends 26, 27, 28, 29 of rod members 22, 23 to position the plug member 65 in the cavities 64, 64. Any suitable means such as an elastomeric strap 67 may be employed to retain the ends of adjacent rod members 22, 23 in abutting relation, with the plug member 65 in assembled position. The strap 67 is attached to bar members 33, 33' by any suitable means, such as clips 68.

Each unit is assembled by resting one of the rod members 22 or 23 of a panel 20 on the ground, plug members 65 are inserted into cavities 64 with a portion thereof protruding outwardly of the cavity 64 and the elastomeric retaining member 67 attached to bar member 33, 33' by clip 68. A second panel member 20 is now arranged in parallel relation to the first panel member 20 and the open ends 64 thereof are passed over the protruding ends of plugs 65. The loose ends of the elastomeric retainers 67 are now clipped upon the bar members 33, 33' of the second panel 20 thus retaining the two panels in assembled relationship. Subsequent panels are assembled in a like manner to form a complete unit. The unit is now rotated 90° to an erect position and subsequent units of any desired number are similarly assembled and moved into adjacent position. Bolts 69, see FIGS. 19 and 20, are now passed through predrilled holes 70 in the adjacent rod members 22, 23 and secured by nuts 71. If desired, elastomeric gasket or washer members 72 may be placed between adjacent rod members 22, 23 to reduce noise occasioned by the "working" of the various units when under external load, such as occasioned by wind.

When the shelter of FIG. 14 is assembled by the panel structure of FIGS. 1 and 2, it is contemplated that the fabric cover members 24 of the various panels may be secured together by any suitable means such as snaps or "zippers" to form a waterproof shelter. A skeleton structure has been disclosed in FIG. 14 erected by assembly of a plurality of panel structures depicted in FIG. 11. It is also contemplated that a fabric could be arranged over or under the skeleton of FIG. 14 to form either a weatherproof shelter or a camouflage cover for military purposes.

A further modification employing the principles of this invention is depicted in FIGS. 17, 18, 21 and 22.

Figure 17:
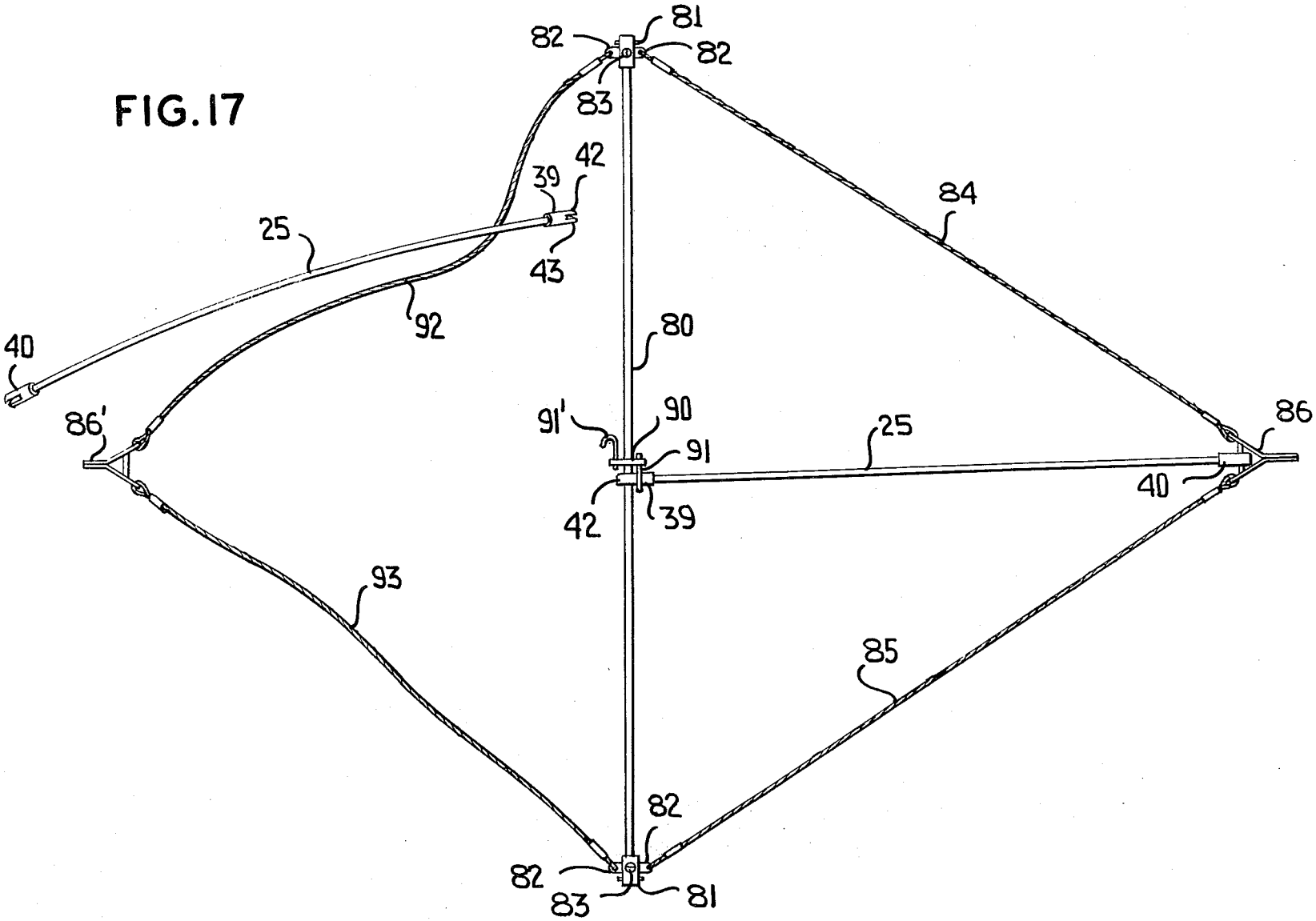
FIG. 17 is a partially assembled plan view of a further modification of the invention.
Figure 21:
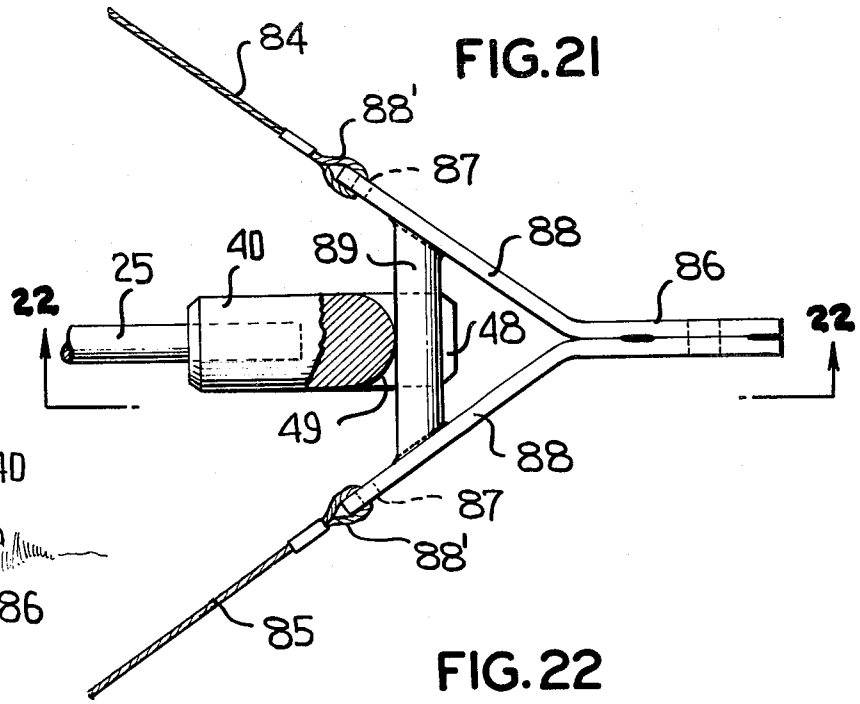
FIG. 21 is a detail, to an enlarged scale of the apex fitting shown in FIG. 17.
Figure 22:
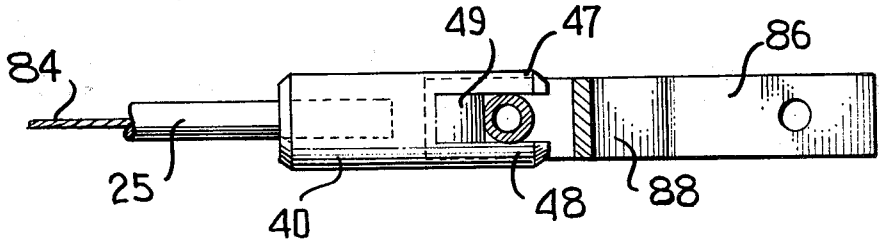
FIG. 22 is a partial section along line 22—22 of FIG. 21.

In FIG. 17 a straight rod member 80 analogous to the rod members 22, 23 of FIGS. 1 and 2 has a fitting 81 attached to the terminal ends thereof. Fittings 81 have diametrically extending tabs 82 secured thereto by any suitable means, such as welding. Set screws 83 retain fittings 81 on the ends of rod member 80. Flexible cables 84, 85 are attached to the tabs 82 such as by swaging, as more clearly shown in the attachment of cables 51 to fittings 52 in FIGS. 12 and 13. A substantially "Y"-shaped fitting 86 having apertures 87 in the legs 88 of the "Y" to receive an eye end 88' of cables 84, 85, the terminal ends of which are swaged to the cables 84, 85. A gusset 89 shown here as cylindrical for illustration purposes only, extends between and is secured to the legs 88 such as by welding. Stress bar 25 is slidably and pivotally mounted over gusset 89 by means of the furcations 47, 48. Legs 88 act as a means to limit the sliding and pivotal movement of stress bar 25 on gusset 89. Stress bar 25 is of greater length in its unassembled position than the horizontal distance between bar member 80 and gusset 89 when the cables 84, 85 are extended to their maximum unstressed condition and rest on a planar surface, such as the ground. To stress cables 84, 85, bar 25 is mounted on gusset 89 at an angle thereto sufficient to allow the furcations 42, 43 to receive rod member 80 in contact with roller 45. Bar 25 is now caused to move along rod member 80, pivoting at 49 on gusset 89 until the fitting 39 contacts stop collar 90. Latch 91 pivotally mounted in stop collar 90 is now placed over end piece 39 of stress rod 25 to retain the rod in position. The act of placing stress bar 25 in its assembled position, as above described, has placed flexible cables 84, 85 under considerable tensile stress, and has foreshortened stress rod 25 by causing the radius of the original arc to shorten thereby forming an arch of greater height than that appearing in the stress rod in its unassembled condition. In the device as so far described, a substantially flat, triangular prestressed frame has been achieved. A triangular fabric panel could be secured to bar 80 and to fitting 86 as a substitute for cables 84, 85 and acting as the sole restraint to the tensile stresses occasioned by the assembly of stress bar 25 between gusset 89 and rod member 80, or the fabric and cables could both be used simultaneously.

Figure 18:
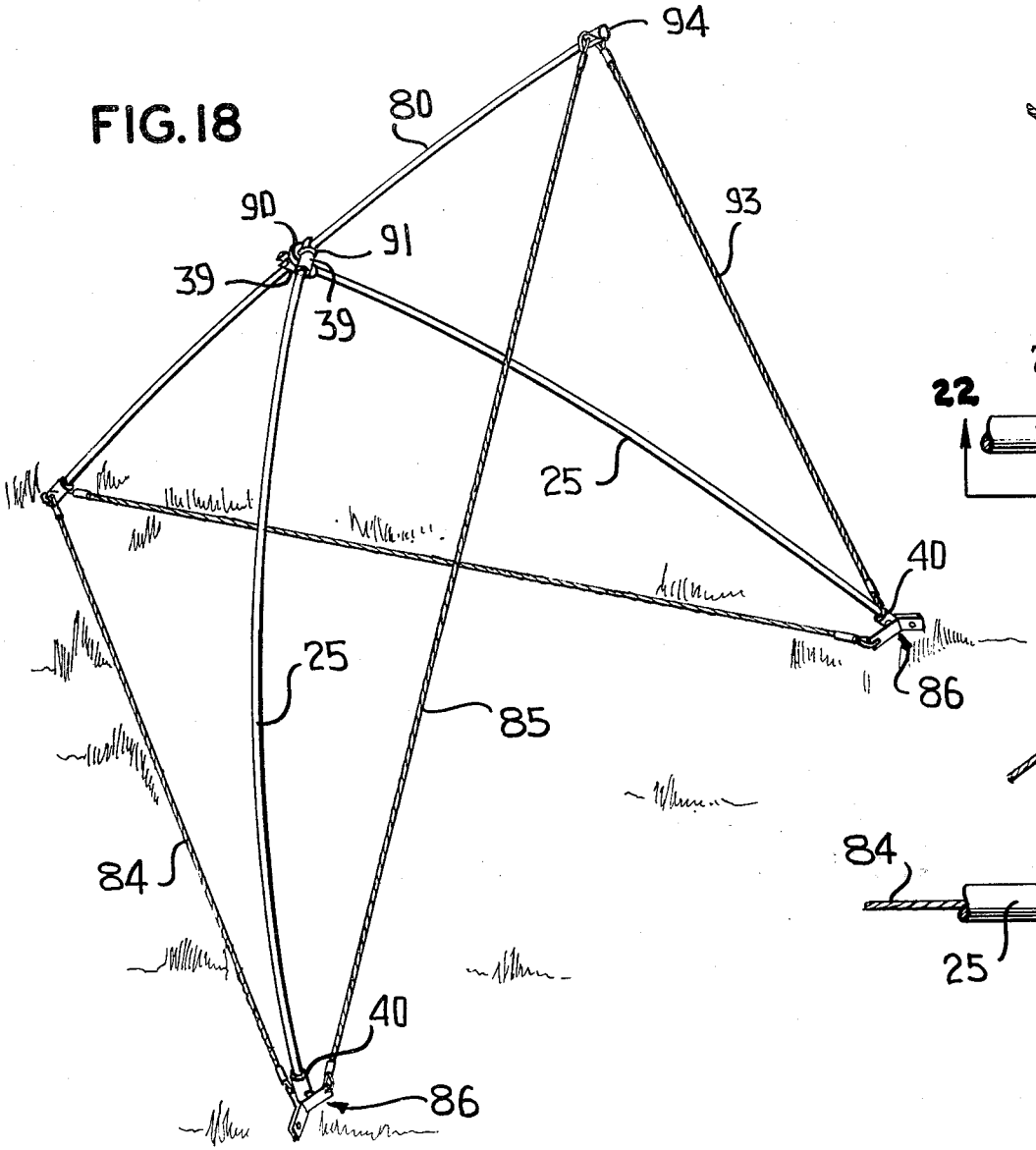
FIG. 18 is a perspective view of the fully assembled device of FIG. 17.

FIG. 17 also discloses a second set of cables 92, 93 fastened to fittings 81 and to a second "Y" member 86'. A second bar member 25, when mounted between the "Y" member 86' and rod 80 and retained in place by catch 91', stresses rod member 80 and cables 92, 93. Rod member 80 is forced to bow outwardly thereby forcing one end 94 of rod member 80 to rise vertically from the ground as shown in FIG. 18, forming a self-sustaining framework of substantially the shape of one-half of a pyramid. The device, preferably covered with a fabric would serve as a lean-to type of shelter.

What is claimed is:

1. A shelter structure capable of being assembled and disassembled including at least one free floating rod member having end portions, restraint means attached adjacent to at least each end portion of said rod member, at least one resilient stress bar having a given original length measured on a horizontal plane, end portions on said stress bar, means supporting said restraint means and one end portion of said stress bar remote from said rod member, constraining means operatively disposed between said rod member and the other end portion of said stress bar to guide slidable movement of said stress bar relative to said rod member, said slidable movement being in a plane including the longitudinal axis of said rod member during assembly and disassembly, the above elements being so constructed and arranged that when in assembled position, the stress bar imposes tensile loading on said restraint means, said loading decreasing the said original length of said stress bar, said restraint means limiting the maximum distance between said rod member and said means supporting the restraint means and one end portion of said stress bar.

2. A panel structure as in claim 1 wherein the resilient stress bar is pre-formed in an arc of a great circle.

3. A panel structure as in claim 1 wherein the restraint means consists of a cable secured adjacent the outer ends of said rod member.

4. A panel structure as in claim 1 wherein adjustable latch means is provided substantially at the mid-point of said rod member and operatively engaging said stress bar to retain said stress bar in assembled position.

5. A panel structure as in claim 1 wherein said constraining means includes a bifurcation at least at one end of said stress bar said bifurcation having a friction reducing means therein to assist in the sliding action of said stress bar with respect to said rod member.

6. A panel structure including spaced apart free floating rod members, each of said rod members having a central portion and end portions, restraining means attached to said rod members at least between said central portion and said end portions, at least one resilient stress bar adapted to be operatively disposed between said rod members, said stress bar having at least a portion thereof formed as an arc of a circle and defining an arch, the radius of said arc, with the stress bar unassembled with respect to said rod members, being of a given dimension, said stress bar having constraining means at each end thereof, the constraining means at one end of said stress bar being so constructed and arranged that said end is restricted substantially to sliding movement with respect to one of said rod members, the constraining means at the other end of said stress bar permitting pivotal movement of said stress bar with respect to said other rod member, whereby said stress bar is restricted in its movement during assembly to substantially a single plane thereby imposing an increasing stress on said restraining means and reducing the radius of said arc as assembly progresses.

7. A device as in claim 6 wherein bar members are attached to said rod members substantially intermediate the ends thereof, said stress bar being movably mounted on said bar members.

8. A device as in claim 7 wherein the rod members are arch shaped.

9. A device as in claim 8 wherein said bar members are disposed below said arch of said rod members, the intersection of a horizontal plane passed through said bar members with a vertical plane passed through said rod members forming substantially a chord with the arc of the arch of said rod members.

10. A device as in claim 7 wherein said bar members are mounted below and to one side of said rod members.

11. A device as set forth in claim 6 wherein said rod members each having attached thereto adjacent the central portion thereof a bar member, the said central portion and end portions of each of said rod members defining a plane, said bar members being displaced inwardly of said plane, said stress bar having a bifurcated portion at each of its terminal ends, one of said bifurcations being adapted to partially encompass one of said bar members in slidable relation thereto, the other bifurcation being adapted to engage the other of said bar members in pivotal relation thereto, said restraining means including a flexible panel means disposed above said arch of said stress bar whereby, as the stress bar is assembled on said bar members the sliding and pivotal motion of said stress bar on said bar members tending to force said rod members apart and to decrease the radius of the arc forming said arch, thereby forcing at least a portion of said arch into supporting engagement with the underside of said flexible panel, external loading of the outside of said panel tending to increase the radius of the arc of said arch in said stress bar and to thereby further stress said flexible panel.

12. A device as in claim 6 wherein the constraining means between the stress bar and rod members, include pivotal means at one end of said stress bar and friction reducing means at the other end of said stress bar.

13. A device as in claim 12, wherein the ends of said stress bar terminate in bifurcations, and the friction reducing means and the pivotal means are disposed within their respective bifurcations.

14. A panel structure as in claim 6 wherein the restraining means include at least a flexible fabric means disposed above the apex of the arch of said stress bar.

15. A panel structure as in claim 6 wherein the restraining means includes at least a plurality of independently acting flexible cable means.

16. A device as in claim 1 wherein said restraint means includes a plurality of flexible cable means, each of said cable means having one end thereof attached to said rod member the other ends of said flexible cable means being disposed in adjacent relation to form an apex means at least one resilient stress bar having one end thereof slidably received on said rod-like member and the other end of said stress bar being received in said apex means.

17. A device as in claim 16 wherein said flexible cable means consist of two pairs of cables, each pair of cables extending in different directions from said rod members, each pair of cables defining an apex at their ends remote from said rod members, and a pair of resilient stress bars each having one end slidably received on said rod member, the other end of each of said stress bars being received in one of the said apex means.

18. A panel structure as in claim 1 wherein the restraining means includes at least two longitudinally extending flexible cable means and at least one diagonally disposed flexible cable means.

* * * * *